US008836705B2

(12) United States Patent
Bolden

(10) Patent No.: US 8,836,705 B2
(45) Date of Patent: Sep. 16, 2014

(54) GENERATING A GRAPHIC FOR APPLICATION TO A SURFACE TO PRODUCE A PLAQUE

(76) Inventor: Russell John Bolden, Glenbrook (AU)

( * ) Notice: Subject to any disclaimer, the term of this patent is extended or adjusted under 35 U.S.C. 154(b) by 526 days.

(21) Appl. No.: 13/085,055

(22) Filed: Apr. 12, 2011

(65) Prior Publication Data

US 2011/0247514 A1 Oct. 13, 2011

(30) Foreign Application Priority Data

Apr. 13, 2010 (AU) ..... 2010901564

(51) Int. Cl.

| | |
|---|---|
| ***G06T 11/20*** | (2006.01) |
| ***B41F 33/00*** | (2006.01) |
| ***B42D 15/00*** | (2006.01) |
| ***B44C 5/04*** | (2006.01) |

(52) U.S. Cl.

CPC ..... *B44C 5/0446* (2013.01)
USPC ..... 345/440; 101/483; 283/61

(58) Field of Classification Search

None
See application file for complete search history.

(56) References Cited

U.S. PATENT DOCUMENTS

| | | | | |
|---|---|---|---|---|
| 5,751,931 | A * | 5/1998 | Cox et al. | 345/440 |
| 5,777,578 | A | 7/1998 | Chang et al. | |
| 6,016,120 | A | 1/2000 | McNabb et al. | |
| 7,505,835 | B2 | 3/2009 | Brust et al. | |
| 2006/0026170 | A1 * | 2/2006 | Kreitler et al. | 707/10 |
| 2007/0088897 | A1 * | 4/2007 | Wailes et al. | 711/3 |
| 2009/0170532 | A1 * | 7/2009 | Lee et al. | 455/456.3 |
| 2009/0199952 | A1 * | 8/2009 | Roque | 156/87 |
| 2009/0259398 | A1 * | 10/2009 | Wang | 701/213 |

FOREIGN PATENT DOCUMENTS

| | | | |
|---|---|---|---|
| JP | 2000122528 | A | 4/2000 |
| TW | 244599 | B | 12/2005 |
| WO | WO-0014482 | A1 | 3/2000 |

OTHER PUBLICATIONS

Byrne, Chrystal; "Gerrard's Lookout"; Aug. 17, 2013; http://www.weekendnotes.com/gerrards-lookout; Figs. "The memorial @ Gerrard's Lookout" and "In Memory of Charlie and Hazel Gerrard".*

* cited by examiner

*Primary Examiner* — Joni Richer
*Assistant Examiner* — Yi Wang
(74) *Attorney, Agent, or Firm* — Harness, Dickey & Pierce, PLC

(57) ABSTRACT

A method, processing system, and/or computer program product for generating a graphic for application to a surface to produce a plaque. In one aspect, the method includes, in a processing system: receiving, from a user, first location data indicative of a first location; receiving, from the user, second location data indicative of a plurality of second locations; determining for each second location, a displacement pair, each displacement pair being indicative of: a distance between the first location and the respective second location; and a direction of the respective second location relative to the first location; and generating, using each displacement pair, graphical data indicative of a graphic for application to a surface, wherein the graphical data is indicative of the distance and direction of each second location relative to the first location.

19 Claims, 4 Drawing Sheets

GENERATING A GRAPHIC FOR APPLICATION TO A SURFACE TO PRODUCE A PLAQUE

TECHNICAL FIELD

The present invention generally relates to a method, processing system and/or a computer program product for generating a graphic for application to a surface to produce a plaque.

BACKGROUND

Plaques are located at a number of tourist areas, such as lookouts, wherein the plaque identifies distances and directions to notable areas of interest relative to the tourist area where the plaque is located. Design and manufacture of the plaque generally includes manually selecting a number of locations on a physical map, then manually calculating the distances and directions to the locations relative to the central location where the plaque is to be installed, then designing the layout of the information to be presented on the plaque, and finally physically manufacturing the plaque according to the designed layout.

Whilst the process of designing the plaque can be achieved using the above-mentioned process, the process is rather slow due to its manual nature. Furthermore, customization of the graphic displayed on the plaque can be difficult, particularly when a location which is to be presented on the plaque is not typically considered notable, thus the manual process of generating the design of the graphic can be slow.

Therefore, there is a need to generate a graphic for application to a surface to produce a plaque, which overcomes or at least ameliorates one or more of the above-mentioned disadvantages or provides a useful alternative.

SUMMARY

In a first broad aspect there is provided a method of generating a graphic for application to a surface to produce a plaque, wherein the method includes, in a processing system:

- receiving, from a user, first location data indicative of a first location;
- receiving, from the user, second location data indicative of a plurality of second locations;
- determining for each second location, a displacement pair, each displacement pair being indicative of:
  - a distance between the first location and the respective second location; and
  - a direction of the respective second location relative to the first location; and
- generating, using each displacement pair, graphical data indicative of a graphic for application to a surface, wherein the graphical data is indicative of the distance and direction of each second location relative to the first location.

In one form, the graphic includes:

- a first marking indicative of the first location;
- a plurality of second markings, wherein each second marking is angularly displaced relative to the first marking according to the respective displacement pair for the respective second location; and
- distance indicia associated with each second marking indicative of the distance between the first and respective second location.

In another form, the second markings includes a plurality of radiating lines, wherein each line is indicative of the direction of the respective second location relative to the first location.

In one embodiment, the graphic includes graphical coordinate indicia associated with at least one of the first location and the second locations, wherein the graphical coordinate indicia is indicative of a graphical coordinate for the respective location.

In another embodiment, the graphic includes:

- first location indicia indicative of a name associated with the first location; and
- second location indicia indicative of a name associated with one or more of the second locations.

In an optional form, the method includes receiving, from the user, description data indicative of one or more user defined descriptions for at least one of the first location the second location.

In another optional form, the method includes generating the graphical data to be indicative of at least one cardinal direction.

In an optional embodiment, the method includes generating the graphical data to be indicative of magnetic north relative to the second markings.

In another optional embodiment, the processing system is a server processing system, wherein the method includes receiving the first location data and the second location data from the user via a user processing system in data communication with the server processing system.

Optionally, the method includes:

- transferring, to the user processing system, computer interpretable instructions indicative of a web-page viewable via an internet browser executable on the user processing system, wherein the web-page includes an interactable map; and
- receiving, from the user processing system, map interaction data indicative of the user interacting with the map data to indicate at least one of the first location and the second location.

In one form, the method includes:

- generating, using the map interaction data, a request to a mapping server processing system to obtain a geographical coordinate for each location indicated by the user interacting with the interactable map; and
- obtaining, using the geographical coordinates, the respective distance and direction for each displacement pair.

In another form, the method includes transferring, to the user processing system, the graphical data, wherein the graphical data is presented to the user for review.

In one embodiment, the method includes:

- receiving graphical amendment data indicative of the user requesting amendments to the graphical data; and
- amending the graphical data according to graphical amendment data.

In another embodiment, the method includes transferring an order request to a manufacturer to manufacture the surface having the graphic applied thereto, wherein the order request is indicative of at least one of the graphical data and the graphic.

In a second broad aspect there is provided a method of applying a graphic to a surface to produce a plaque, wherein the method includes:

- performing the method according to the first aspect; and
- applying, using the graphical data, the graphic to the surface to produce a plaque.

In one form, the step of applying the graphic to the surface includes one of:

etching at least part of the graphic into the surface;
embossing at least part of the graphic into the surface;
imprinting at least part of the graphic into the surface;
engraving at least part of the graphic into the surface;
laser marking at least part of the graphic into the surface;
printing at least part of the graphic on the surface; and
stamping at least part of the graphic into the surface.

In a third broad aspect there is provided a plaque including a surface bearing a graphic, wherein the plaque is manufactured using the method according to the first aspect.

In a fourth broad aspect there is provided a processing system for generating a graphic for application to a surface to produce a plaque, wherein the processing system is configured to:

receive, from a user, first location data indicative of a first location;
receive, from the user, second location data indicative of a plurality of second locations;
determine for each second location, a displacement pair, each displacement pair being indicative of:
a distance between the first location and the respective second location; and
a direction of the respective second location relative to the first location; and
generate, using each displacement pair, graphical data indicative of the graphic for application to a surface, wherein the graphical data is indicative of the distance and direction of each second location relative to the first location.

In a fifth broad aspect there is provided a non-transitory computer program product for use in generating a graphic for application to a surface to produce a plaque, the non-transitory computer program product including computer executable code which when executed by a processing system, causes the processing system to:

receive, from a user, first location data indicative of a first location;
receive, from the user, second location data indicative of a plurality of second locations;
determine for each second location, a displacement pair, each displacement pair being indicative of:
a distance between the first location and the respective second location; and
a direction of the respective second location relative to the first location; and
generate, using each displacement pair, graphical data indicative of the graphic for application to a surface, wherein the graphical data is indicative of the distance and direction of each second location relative to the first location.

Other embodiments will be described throughout the description of the example embodiments.

BRIEF DESCRIPTION OF THE FIGURES

Example embodiments should become apparent from the following description, which is given by way of example only, of at least one preferred but non-limiting embodiment, described in connection with the accompanying figures.

DESCRIPTION OF EMBODIMENTS

Figure 1:
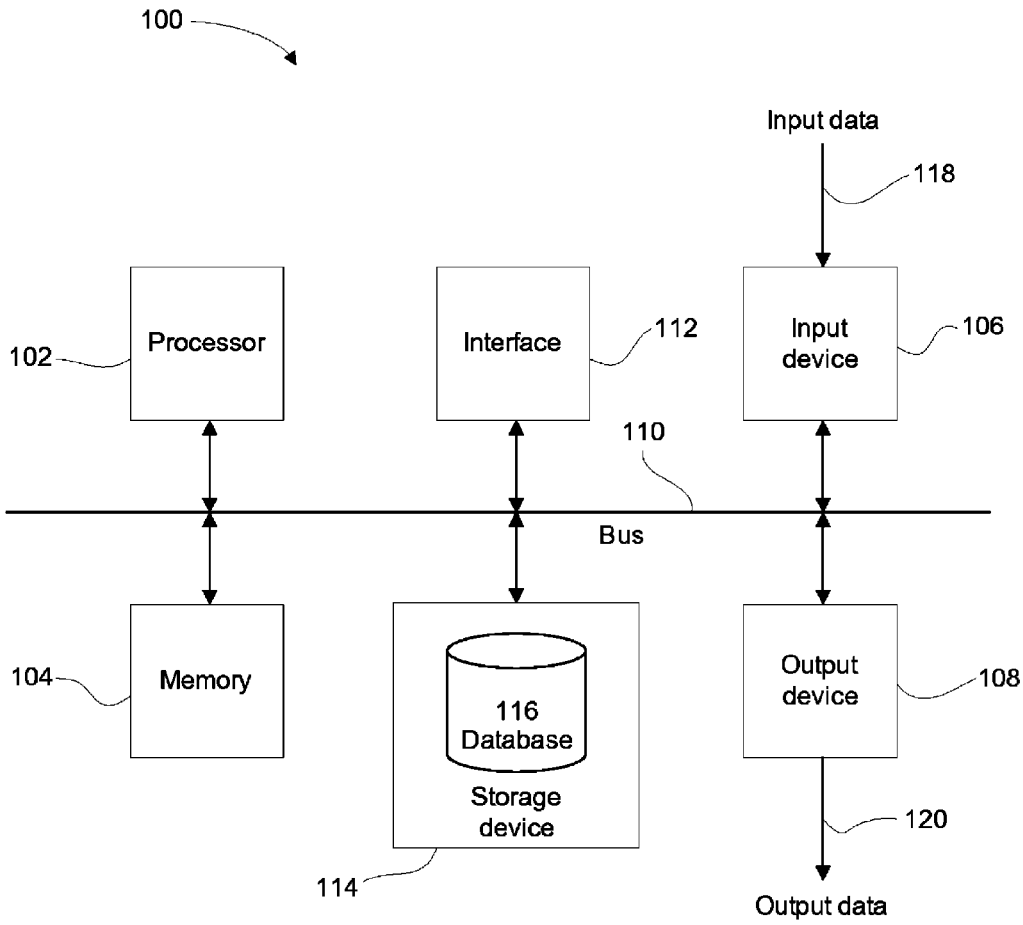
FIG. 1 illustrates a functional block diagram of an example processing system that can be utilised to embody or give effect to a particular embodiment.

The following modes, given by way of example only, are described in order to provide a more precise understanding of the subject matter of a preferred embodiment or embodiments. In the figures, incorporated to illustrate features of an example embodiment, like reference numerals are used to identify like parts throughout the figures.

A particular embodiment can be realised using a processing system, an example of which is shown in FIG. 1. In particular, the processing system 100 generally includes at least one processor 102, or processing unit or plurality of processors, memory 104, at least one input device 106 and at least one output device 108, coupled together via a bus or group of buses 110. In certain embodiments, input device 106 and output device 108 could be the same device. An interface 112 also can be provided for coupling the processing system 100 to one or more peripheral devices, for example interface 112 could be a PCI card or PC card. At least one storage device 114 which houses at least one database 116 can also be provided. The memory 104 can be any form of memory device, for example, volatile or non-volatile memory, solid state storage devices, magnetic devices, etc. The processor 102 could include more than one distinct processing device, for example to handle different functions within the processing system 100.

Input device 106 receives input data 118 and can include, for example, a keyboard, a pointer device such as a pen-like device or a mouse, audio receiving device for voice controlled activation such as a microphone, data receiver or antenna such as a modem or wireless data adaptor, data acquisition card, etc. Input data 118 could come from different sources, for example keyboard instructions in conjunction with data received via a network. Output device 108 produces or generates output data 120 and can include, for example, a display device or monitor in which case output data 120 is visual, a printer in which case output data 120 is printed, a port for example a USB port, a peripheral component adaptor, a data transmitter or antenna such as a modem or wireless network adaptor, etc. Output data 120 could be distinct and derived from different output devices, for example a visual display on a monitor in conjunction with data transmitted to a network. A user could view data output, or an interpretation of the data output, on, for example, a monitor or using a printer. The storage device 114 can be any form of data or information storage means, for example, volatile or non-volatile memory, solid state storage devices, magnetic devices, etc.

In use, the processing system 100 is adapted to allow data or information to be stored in and/or retrieved from, via wired or wireless communication means, the at least one database 116 and/or the memory 104. The interface 112 may allow wired and/or wireless communication between the processing unit 102 and peripheral components that may serve a specialised purpose. The processor 102 receives instructions as input data 118 via input device 106 and can display processed results or other output to a user by utilising output device 108. More than one input device 106 and/or output device 108 can be provided. It should be appreciated that the processing system 100 may be any form of terminal, server, specialised hardware, or the like.

Figure 2:
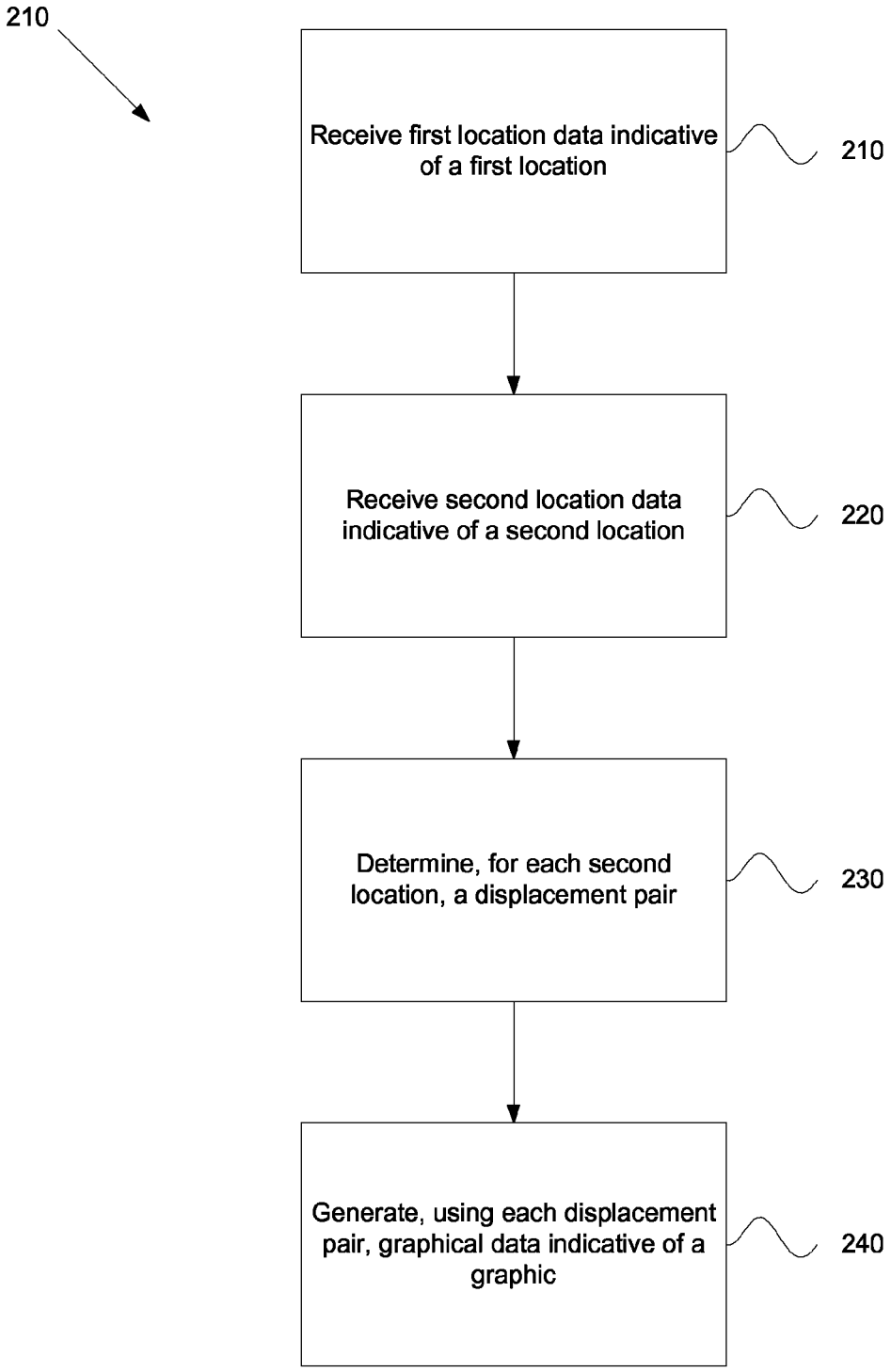
FIG. 2 illustrates a flowchart representing an example method for generating a graphic for application to a surface.

Referring to FIG. 2 there is shown a flowchart representing a method of generating a graphic for application to a surface.

In particular, at step 210 the method 200 includes receiving, from a user, first location data indicative of a first location. At step 220, the method 200 includes receiving, from the user, second location data indicative of a plurality of second locations. At step 230, the method 200 includes determining for each second location, a displacement pair. Each displacement pair is indicative of a distance between the first location and the respective second location, and a direction of the respective second location relative to the first location. At step 240, the method 200 includes generating, using each displacement pair, graphical data indicative of the graphic for application to a surface, wherein the graphical data is indicative of the distance and direction of each second location relative to the first location.

Figure 3:
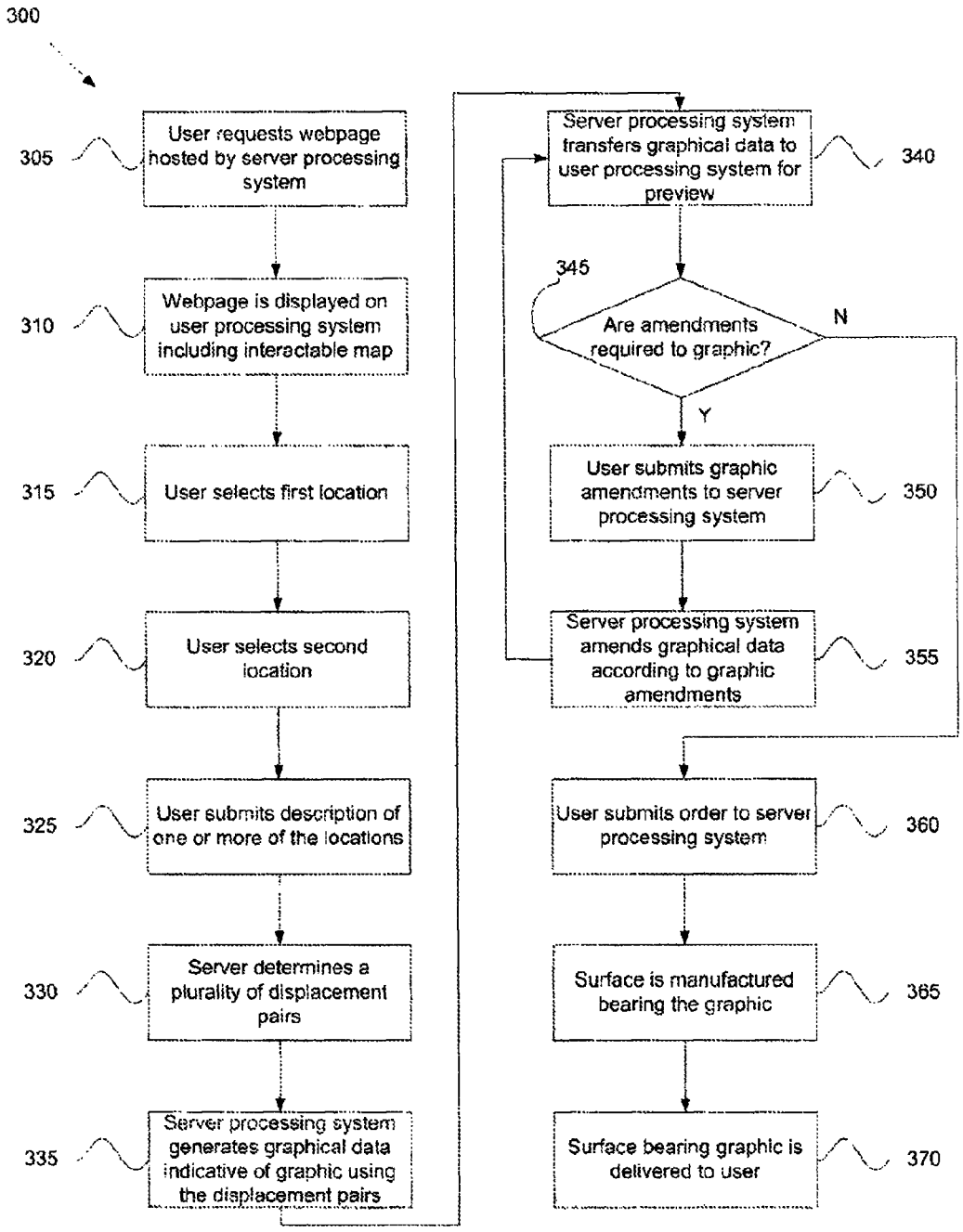
FIG. 3 illustrates a flowchart representing a more detailed example method for generating a graphic for application to a surface.

Referring to FIG. 3 there is shown a flowchart representing a more detailed method of generating a graphic for application to a surface.

In particular, at step 305, the method 300 includes a user processing system visiting a webpage hosted by a server processing system. The user processing system preferably retrieves the webpage using an internet browser.

At step 310, the method 300 includes the user processing system receiving computer interpretable instructions representative of the webpage which are interpreted by the internet browser for presentation to the user. The webpage may include map data indicative of an interactable map interface. In one option, the map data may be provided by a server processing system which is embedded in the webpage. In one form, the embedded map data may include Google Maps™ (Google Maps having been trademarked by Google, Inc.).

At step 315, the method includes the user interacting with the map interface to identify and select the first location. First location data indicative of the first location is then transferred from the user processing system to the server processing system. At step 320, the method includes the user interacting with the map interface to identify and select the plurality of second locations. Second location data indicative of the plurality of second locations is then transferred from the user processing system to the server processing system.

Steps 315 and 320 may be implemented via use of a search form. In particular, the webpage may include a search form including one or more input fields, wherein the user can populate at least one of the input fields with a search query. The search query can then be transferred to a mapping server processing system to execute the search query. In particular, the mapping server may provide an API which enables particular functions to be remotely called by the server processing system, such as a searching function. In the event that one or more geographical locations are identified which at least partially satisfy the search query, the server processing system may return search result data to the user processing system, optionally via the server processing system, indicative of the one or more potential geographical locations which are presented to the user via the internet browser. The user may then select one of the potential geographical locations, wherein location data indicative of the selected location is transferred to the server processing system. The map interface may be updated with a marker indicating the location(s) selected.

At step 325, the method includes the user optionally providing a customized description of the one or more of the selected locations. In particular, the user may input, via an input field of the webpage, the customized description of one or more of the selected locations. For example, in the event that the user has selected a location associated with his/her parent's house, the user may input the customized field "Mom and Dad's house". Customized description data indicative of one or more customized descriptions for one or more selected locations is transferred to the server processing system for recordal.

At step 330, the method includes the server processing system determining a plurality of displacement pairs according to the number of second locations selected by the user. In particular, in the event that the user has selected five second locations, then the server processing system determines five displacement pairs. In one form, a geographical coordinate may be determined for the first location and each second location, wherein the geographical coordinates may be used to calculate the distances and the direction between the first location and each of the second locations.

Specifically, the server processing system may apply the 'Haversine' formula to determine the distance between two geographical coordinates. Alternatively, the server processing system may apply the 'spherical law of cosines' to determine the distance between the first location and each second location. It will be appreciated that there are also other methods which can be used to determine the distance between two locations. In another manner, a request may be transferred to a mapping server processing system, wherein the request is indicative of the geographical coordinates of the two locations and wherein the mapping server processing system may calculate the distance between the locations and return the distance to the server processing system.

The server processing system may determine, or request via the mapping server processing system, the distances between the latitude components of the first and second location and the distance between the longitude components of the first and second location. Then, using trigonometry, the server processing system may determine the angular displacement or direction of the second location relative to the first location.

Figure 4:
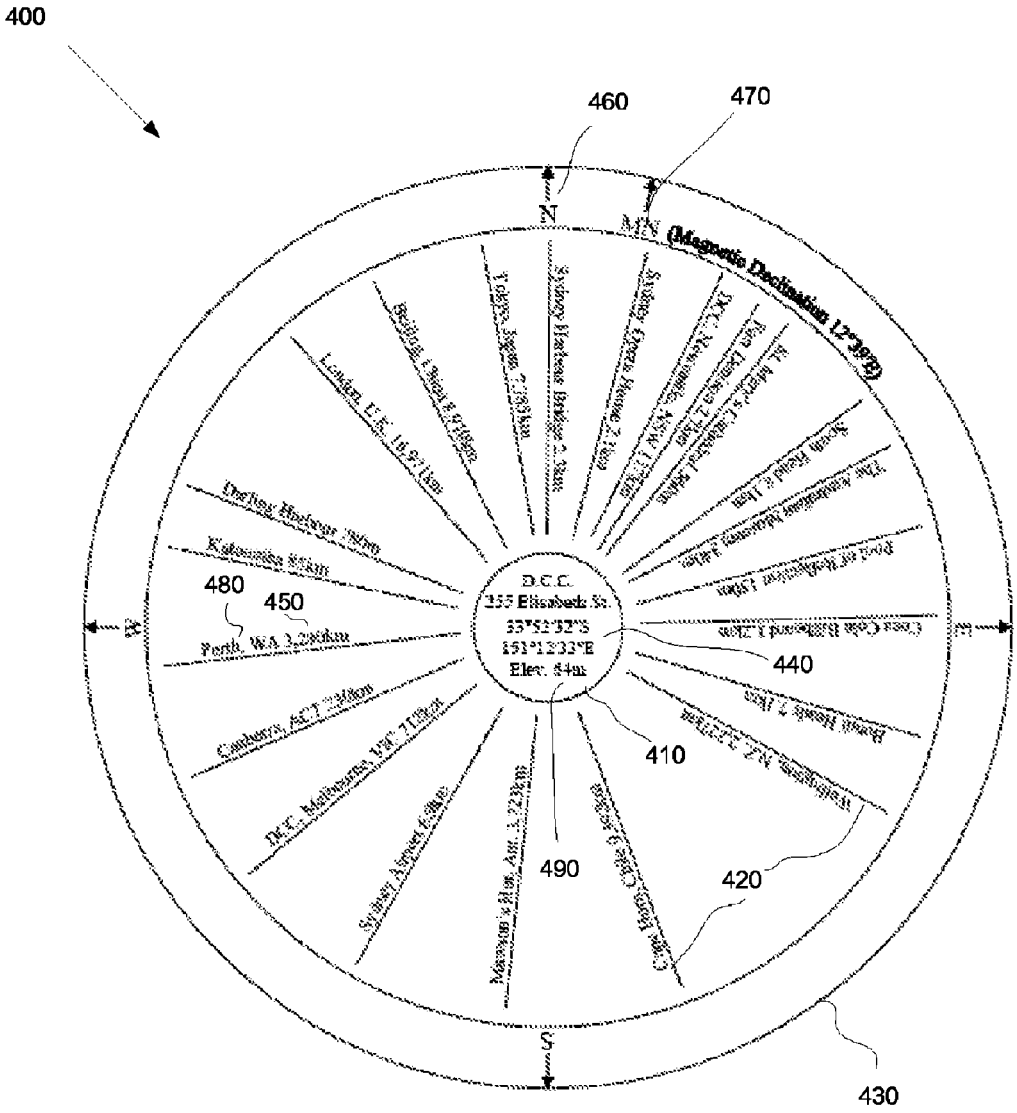
FIG. 4 illustrates an example of a graphic for application to a surface.

At step 335, the method includes the server processing system generating, using the displacement pairs determined in step 330, graphical data indicative of a graphic for application to a surface. An example of a graphic 400 generated by the server processing system is illustrated in FIG. 4, wherein the first location is 255 Elizabeth Street, Sydney, New South Wales 2000, Australia.

In one form, the server processing system generates the graphic which includes a first marking 410 substantially in the centre of the graphic which represents the first location. A border 430 is then placed about the first marking. Second markings in the form of a series of radiating lines 420 are then generated on the graphic 400 which radiate from the first marking 410 and end toward or at the border 430. The lines 420 radiate from the first marking 410 at an angular displacement relative to the direction recorded for the corresponding displacement pair determined in step 335.

Indicia 450 indicative of the distance between the first location and each second location may be located near or associated with each radiating line 420 of the graphic 400. Additionally, geographic coordinate indicia 440 indicative of a geographical coordinate for at least some of the locations may also be recorded on the graphic, such as shown in example for the first location in FIG. 4. Description indicia 480 indicative of a description, and/or customized description, of the location may also be recorded on the graphic 400. Preferably, one or more cardinal directions 460 are included on the graphic 400, such as cardinal north. Additionally or alternatively one or more magnetic directions 470, such as magnetic north, may be indicated on the graphic 400. Additionally, elevation indicia 490 may be located near or associated with one or more of the locations, wherein the elevation indicia is indicative of the elevation of the one or more locations relative to sea level. Additionally, travel time indicia (not shown) may be located near or associated with each radiating line 420 of the graphic 400, wherein the travel time indicia is indicative of the travel time, via a particular travel means such as a automobile, between the first location to at least some of the second locations. The elevation indicia and the travel time indicia may be determined via one or more requests by the server processing system to the mapping server processing system using data indicative of the first and second locations.

At step 340, the method includes the server processing system transferring the graphical data to the user processing system for the user to preview. In one form, the graphical data is interpreted by the internet browser and the graphic is displayed to the user via the display device 108.

At step 345, the method includes the user determining and providing feedback as to whether the graphic is acceptable. In the event that the graphic requires amendment, the method proceeds to step 350. In the event that the graphic is considered acceptable by the user, the method proceeds to step 360. The feedback may be provided via user selection of a user intractable button, or the like, displayed via the internet browser.

At step 350, the user submits graphical amendments to the graphic, wherein graphical amendment data indicative of the graphical amendments is transferred from the user processing system to the server processing system. At step 355, the method includes the server processing system amending the graphical data according to the graphical amendment data. The method then proceeds back to step 340 where the graphical data is then transferred to the user processing system for the user to preview.

At step 360, the method includes the user placing an order for the graphic to be applied to a surface. In one form, order data may be transferred from the user processing system to the server processing system indicative of the surface which the user has selected for having the graphic applied thereto. For example, the user may be able to select from a number of rigid surfaces, preferably different metallic surfaces. Additionally or alternatively, the order data may be indicative of an application method for use in applying the graphic to the surface. For example, the application methods available for selection may include etching at least part of the graphic into the surface, embossing at least part of the graphic into the surface, imprinting at least part of the graphic into the surface, engraving at least part of the graphic into the surface, laser marking at least part of the graphic into the surface, printing at least part of the graphic on the surface, and/or stamping at least part of the graphic into the surface. The order data may also include user details for delivering the manufactured surface. The order data may also include payment details for financial payment of the manufacturing of the surface.

At step 365, the method includes a manufacturer manufacturing the surface bearing the graphic in accordance with the received order data and the graphical data. It will be appreciated that an entity which operates the server processing system may also be the manufacturer, however, this is not essential and that the entity which operates the server processing system transfers the order request to the manufacturer for manufacturing the surface bearing the graphic.

At step 370, the method includes delivery of the surface to the user. At step 375, the method includes the user installing the surface bearing a graphic, wherein the surface bearing the graphic is provided in the form of a plaque. The plaque may be installed by aligning one or more of magnetic directions, such as magnetic north, via a compass so that the plaque is correctly orientated for installation.

At least some of the above embodiments may take the form of an entirely hardware embodiment, an entirely software embodiment, firmware, or an embodiment combining software and hardware aspects.

Many modifications will be apparent to those skilled in the art without departing from the scope of the present invention.

The invention claimed is:

1. A method of generating a graphic for application to a surface to produce a plaque, wherein the method includes, in a processing system:

transferring a map interface to a user processing system operated by a user;

receiving, from the user via interaction with the map interface using the user processing system, first location data indicative of a first location;

receiving, from the user via interaction with the map interface using the user processing system, second location data indicative of a plurality of second locations;

determining for each second location, a displacement pair thereby determining a plurality of displacement pairs, each displacement pair being indicative of:

a distance between the first location and the respective second location; and an angular displacement of the respective second location relative to the first location; and generating, using each displacement pair, graphical data indicative of a graphic for application to a surface, wherein the graphical data is indicative of the distance and the angular displacement of each second location relative to the first location, wherein the graphic is not part of the map interface, wherein the graphic includes a plurality of lines radially extending from a center area of the graphic, wherein each line is generated according to one of the displacement pairs such that each line radially extends from the center area in a direction according to the respective angular displacement of the respective second location relative to the first location as indicated by the corresponding displacement pair, wherein the graphic is generated by the processing system to include a plurality of second location textual indicia, each of the plurality of second location textual indicia being indicative of one of the second locations and positioned adjacent the line for the respective second location, wherein each the plurality of second location textual indicia is indicative of a name of the corresponding second location and the distance of the respective displacement pair for the respective second location, wherein each of the plurality of second location textual indicia is tilted to be parallel to the respective line which the respective second location indicia is adjacent thereto such that the plurality of second location textual indicia are tilted at different angles in the graphic.

2. The method according to claim 1, wherein the graphic includes graphical coordinate indicia associated with at least one of the first location and the second locations, wherein the graphical coordinate indicia is indicative of a graphical coordinate for the respective location.

3. The method according to claim 1, wherein the graphic includes, first location indicia indicative of a name associated with the first location.

4. The method according to claim 3, wherein the method includes receiving, from the user, the name of one or more of the first and second locations, wherein the name received is defined by the user at user processing system.

5. The method according to claim 1, wherein the graphic includes at least one cardinal direction indicia.

6. The method according to claim 1, wherein of the graphic includes a magnetic north indicia.

7. The method according to claim 1, wherein the processing system is a server processing system.

8. The method according to claim 7, wherein the method includes, transferring, to the user processing system, computer interpretable instructions indicative of a web-page viewable via an internet browser executable on the user processing system, wherein the web-page includes the map interface.

9. The method according to claim 8, wherein the method includes:

generating a request to a mapping server processing system to obtain a geographical coordinate for each location indicated by the user interacting with the map interface; and obtaining, using the geographical coordinates, the respective distance and angular displacement for each displacement pair.

10. The method according to claim 7, wherein the method includes transferring an order request to a manufacturer to manufacture the surface having the graphic applied thereto, wherein the order request is indicative of at least one of the graphical data and the graphic.

11. The method according to claim 1, wherein the method includes transferring, to the user processing system, the graphical data, wherein the graphical data is presented to the user for review.

12. The method according to claim 11, wherein the method includes:

receiving graphical amendment data indicative of the user requesting amendments to the graphical data; and amending the graphical data according to graphical amendment data.

13. A plaque including a surface bearing a graphic, wherein the plaque is manufactured using the method according to claim 1.

14. A method of applying a graphic to a surface to produce a plaque, wherein the method includes:

performing the method according to claim 1; and applying, using the graphical data, the graphic to the surface to produce a plaque.

15. The method according to claim 14, wherein the step of applying the graphic to the surface includes one of:

etching at least part of the graphic into the surface;

embossing at least part of the graphic into the surface;

imprinting at least part of the graphic into the surface;

engraving at least part of the graphic into the surface;

laser marking at least part of the graphic into the surface;

printing at least part of the graphic on the surface; and stamping at least part of the graphic into the surface.

16. A non-transitory computer readable medium storing computer executable code for controlling a processor, the computer executable code causing the processor to:

transfer a map interface to a user processing system operated by a user;

receive, from the user via interaction with the map interface using the user processing system, first location data indicative of a first location;

receive, from the user via interaction with the map interface using the user processing system, second location data indicative of a plurality of second locations;

determine for each second location, a displacement pair to determine a plurality of displacement pairs, each of the plurality of displacement pairs being indicative of, a distance between the first location and the respective second location, and an angular displacement of the respective second location relative to the first location; and generate, using each displacement pair, graphical data indicative of a graphic for application to a surface, wherein the graphical data is indicative of the distance and the angular displacement of each second location relative to the first location, wherein the graphic is not part of the map interlace, wherein the graphic includes a plurality of lines radially extending from a center area of the graphic, wherein each line is generated according to one of the displacement pairs such that each line radially extends from the center area in a direction according to the respective angular displacement of the respective second location relative to the first location as indicated by the corresponding displacement pair, wherein the graphic is generated by the processor to include a plurality of second location textual indicia, each of the plurality of second location textual indicia being indicative of one of the second locations and positioned adjacent the line for the respective second location, wherein each of the plurality of second location textual indicia is indicative of a name of the corresponding second location and the distance of the respective displacement pair for the respective second location, wherein each of the plurality of second location textual indicia is tilted to be parallel to the respective line which the respective second location indicia is adjacent thereto such that the plurality of second location textual indicia are tilted at different angles graphic.

17. A processing system for generating a graphic for application to a surface to produce a plaque, wherein the processing system includes a processor and a communication device, wherein:

the communication device transfers a map interface to a user processing system operated by a user;

the communication device receives, from a user via interaction with the map interface using the user processing system, first location data indicative of a first location;

the communication device receives, from the user via interaction with the map interface using the user processing system, second location data indicative of a plurality of second locations;

the processor determines for each second location, a displacement pair thereby determining a plurality of displacement pairs, wherein each displacement pair is indicative of, a distance between the first location and the respective second location, and an angular displacement of the respective second location relative to the first location; and the processor generates, using the plurality of displacement pairs, graphical data indicative of the graphic for application to a surface, wherein the graphic is not part of the map interface, wherein the graphic includes a plurality of lines radially extending from a center area of the graphic, wherein each line is generated according to one of the displacement pairs such that each line radially extends from the center area in a direction according to the respective angular displacement of the respective second location relative to the first location as indicated by the corresponding displacement pair, wherein the graphic is generated by the processor to include a plurality of second location textual indicia, each second location textual indicia being indicative of one of the second locations and positioned adjacent the line for the respective second location, wherein each second location textual indicia is indicative of a name of the corresponding second location and the distance of the respective displacement pair for the respective second location, wherein each second location textual indicia is tilted to be parallel to the respective line which the respective second location indicia is adjacent thereto such that the plurality of second location textual indicia are tilted at different angles in the graphic.

18. The processing system according to claim 17, wherein the graphic includes first location textual indicia indicative of a name associated with the first location positioned at the central area of the graphic.

19. The processing system according to claim 18, wherein the communication device receives, from the user processing system operated by the user, the name of one or more of the first and second locations, wherein the name received is defined by the user at the user processing system.

* * * * *